US007575262B2

(12) United States Patent
Alba et al.

(10) Patent No.: US 7,575,262 B2
(45) Date of Patent: Aug. 18, 2009

(54) QUICK RELEASE DOVETAIL LIFT COUPLING

(75) Inventors: Tony J. Alba, West Covina, CA (US); Christian Volz, Chatsworth, CA (US)

(73) Assignee: CBC Industries, Valdosta, GA (US)

( * ) Notice: Subject to any disclaimer, the term of this patent is extended or adjusted under 35 U.S.C. 154(b) by 0 days.

(21) Appl. No.: 10/407,755

(22) Filed: Apr. 4, 2003

(65) Prior Publication Data

US 2003/0222470 A1 Dec. 4, 2003

Related U.S. Application Data

(60) Provisional application No. 60/381,441, filed on May 16, 2002, provisional application No. 60/370,457, filed on Apr. 4, 2002.

(51) Int. Cl.
*B66C 1/66* (2006.01)

(52) U.S. Cl. ..... 294/89; 294/93

(58) Field of Classification Search ..... 294/89, 294/93, 97, 1.1, 82.1, 94, 96; 410/101, 102, 410/106, 116; 52/122.1, 125.1, 586.2
See application file for complete search history.

(56) References Cited

U.S. PATENT DOCUMENTS 764,281 A * 7/1904 Duncan ..... 294/89
956,938 A * 5/1910 Lewis ..... 294/89
981,365 A * 1/1911 Birnie et al. ..... 294/89
1,851,116 A * 3/1932 Spiro ..... 294/95
1,938,485 A * 12/1933 Cossor ..... 294/89
2,404,775 A * 7/1946 Ehmann ..... 294/89
2,610,889 A * 9/1952 Penn ..... 294/97
4,238,940 A * 12/1980 McWhorter ..... 70/14
4,278,425 A * 7/1981 Hirbod ..... 294/97
4,304,432 A 12/1981 Silva
4,342,178 A * 8/1982 Benton et al. ..... 294/89
4,575,144 A 3/1986 Silva et al.
6,131,976 A 10/2000 Silva

* cited by examiner

*Primary Examiner*—Paul T Chin
(74) *Attorney, Agent, or Firm*—Bruce A. Jagger

(57) ABSTRACT

A generally X-shaped lift coupling for use with a conventional dovetail socket. One leg of the X-shaped lift coupling slides axially in a keyway in the other leg between a position where the lower end of the sliding leg is engaged with an angularly extending wall of the dovetail socket, and a position where the sliding leg is fully disengaged from the dovetail socket. A retainer holds the slidable leg in assembled relationship with the fixed leg. At least the fixed leg includes a lifting eye for engagement by a lifting member. The application of a lifting force to the lifting eye causes the lower ends of the legs to wedgedly engage the dovetail socket to lock the lift coupling to the dovetail socket. When the slidable leg is also provided with a lifting eye, the two eyes are generally in registry when the slidable leg is fully engaged with the dovetail socket. Insertion of a lifting member through both eyes locks the two legs together in an assembled configuration.

10 Claims, 3 Drawing Sheets

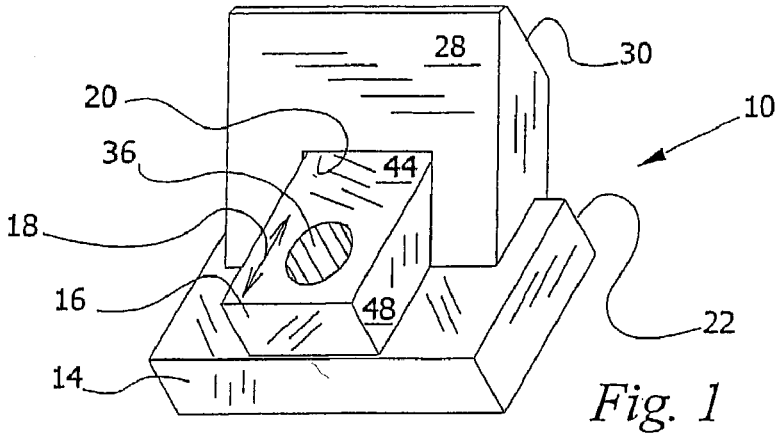
Fig. 1
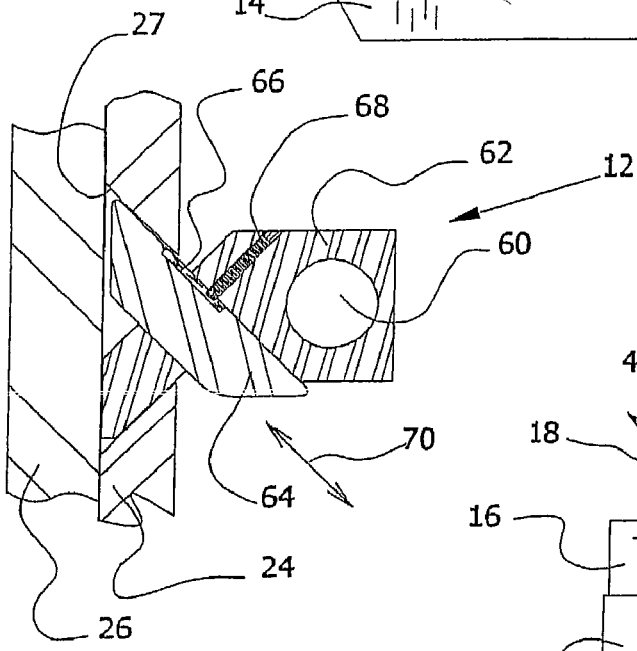
Fig. 11
Fig. 2
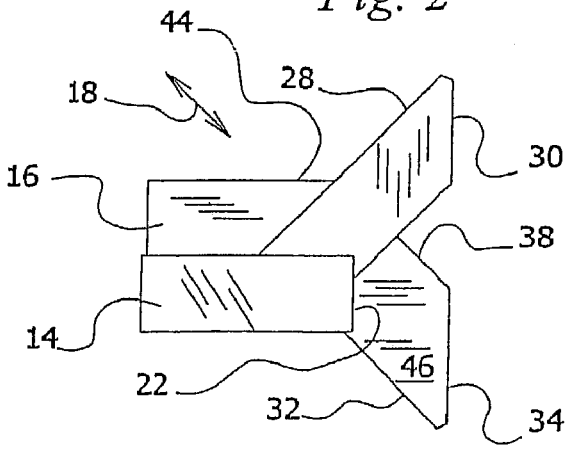
Fig. 12
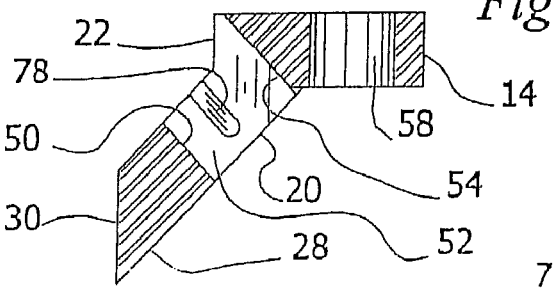
Fig. 13
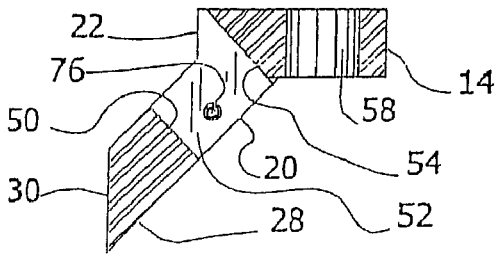

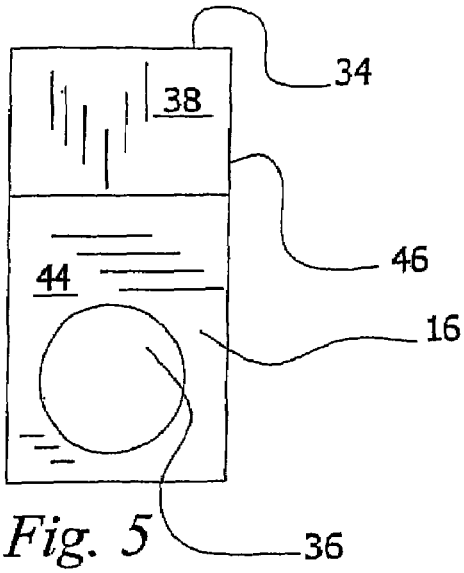
Fig. 5
Fig. 6
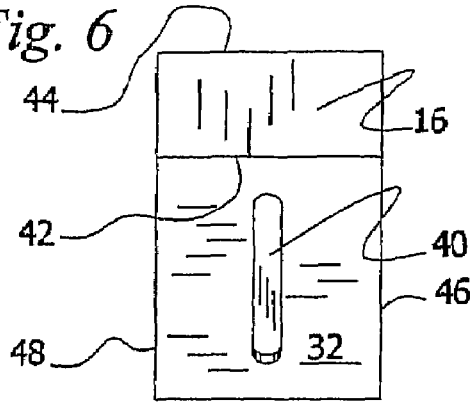
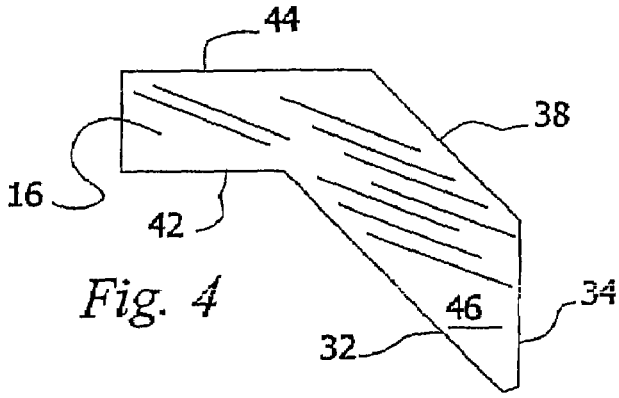
Fig. 4
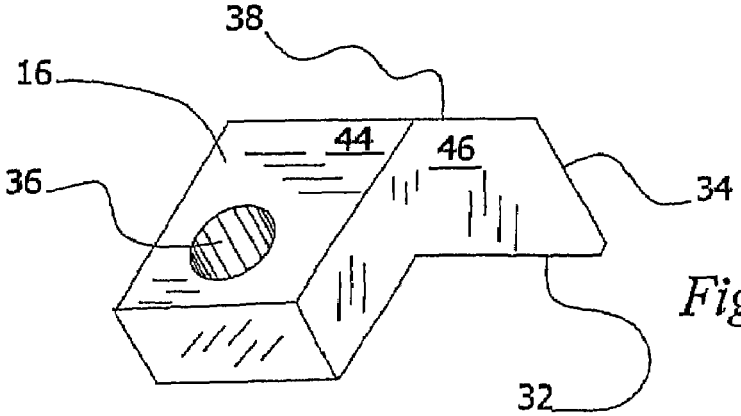
Fig. 3
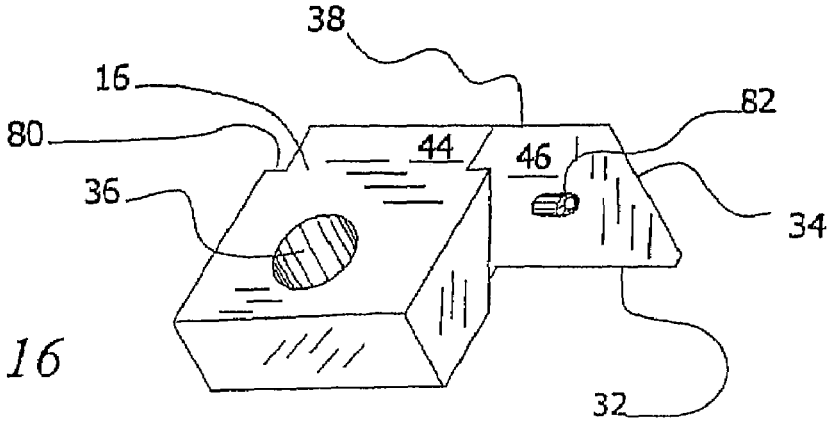
Fig. 16

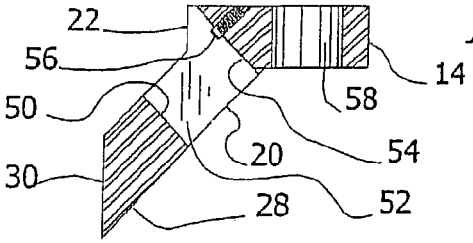
Fig. 9
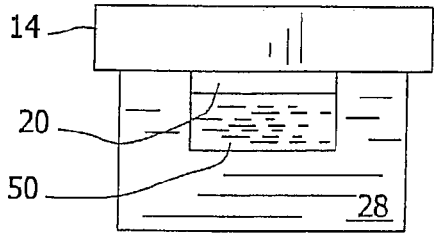
Fig. 8
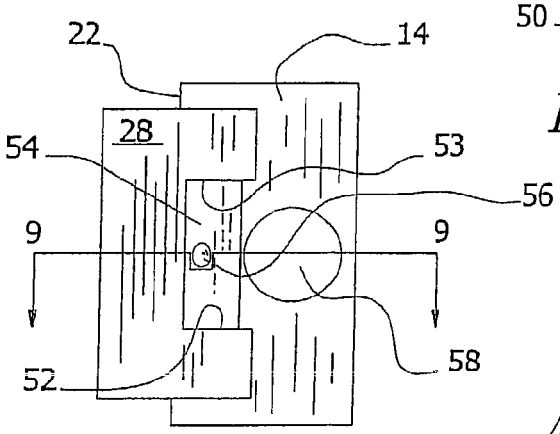
Fig. 10
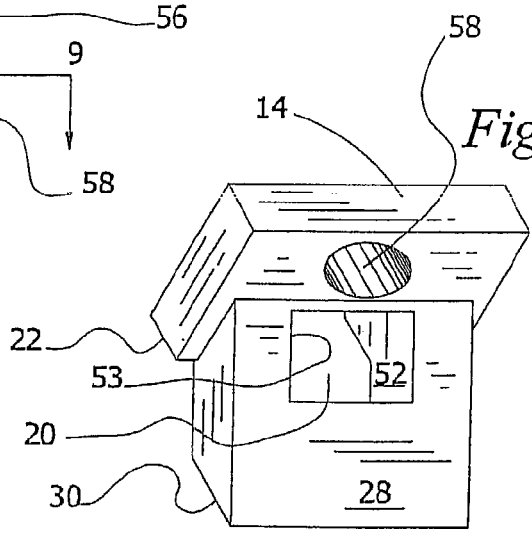
Fig. 7
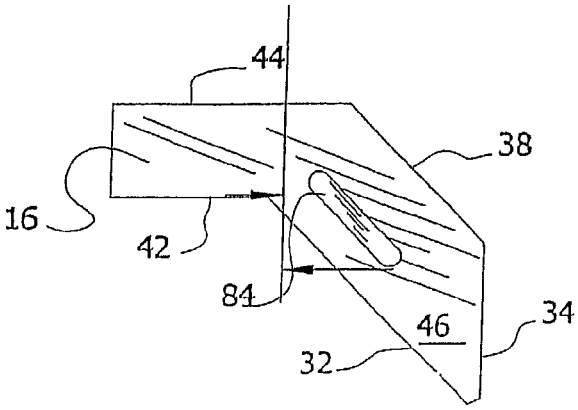
Fig. 15
Fig. 14
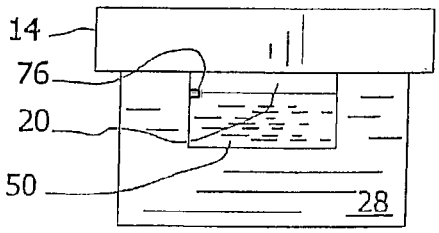

QUICK RELEASE DOVETAIL LIFT COUPLING

RELATED APPLICATIONS

Applicant claims the benefit of Provisional No. 60/370,457, filed Apr. 4, 2002 and Provisional No. 60/381,441, filed May 16, 2002.

BACKGROUND OF THE INVENTION

1. Field of the Invention

The invention relates in general to lift couplings and, in particular, to quick disconnect lift couplings that mount to loads through dovetail sockets.

2. Description of the Prior Art

It is well recognized that load lifting devices may be coupled to loads through dovetail sockets. See, for example, Silva U.S. Pat. No. 4,304,432, Silva et al. U.S. Pat. No. 4,575,144, and Silva U.S. Pat. No. 6,131,976. In general, a dovetail socket includes a pair of angularly projecting walls that are adapted to securely engage the toes of a lift coupling. Previously proposed expedients had generally required that elements of the load lifting devices be inserted into a dovetail socket and then rotated to engage the mating surfaces of the dovetail socket. Complicated locking expedients were generally provided to hold the load lifting devices assembled to the dovetail socket. Any impairment by, for example, debris or damage, to the rotative capability of the elements potentially rendered the coupling unusable or unsafe. Unless the elements of the load lifting devices are reliably and ruggedly held together in one assembly when the device is being handled, transported and stored, one element is likely to become lost or broken, rendering the device useless. Also, if any assembly is required at the site of usage, or at a general repair facility, there is the potential for misassembly, resulting in a safety hazard. The manufacturing of forgings and castings is relatively inexpensive as compared to the manufacturing of machined parts. The risks of misassembly, lost elements, damaged elements, and the costs of manufacturing all increase with the number of separate parts. Also, as the number of parts increases the ruggedness of the device diminishes. The device under certain circumstances should be easy to disassemble into its constituent elements so that if one part becomes damaged, it can be replaced or repaired without discarding the entire device. The configuration of the device should be such that it can not be misassembled. The configuration also should be such that where the option of disassembly is not desired, substantially permanent assembly can be easily achieved. Engagement and disengagement to a mating dovetail socket should be accomplished without the use of any tools.

These and other difficulties of the prior art have been overcome according to the present invention.

BRIEF SUMMARY OF THE INVENTION

A preferred embodiment of the lift coupling according to the present invention comprises two dovetail socket engaging elements. The dovetail socket engaging elements are slidably interengaged so that a second element slides axially of itself through a passageway in the first element between fully engaged and fully disengaged positions with a corresponding dovetail socket. Preferably, the passageway extends entirely through the first element at such an angle that, in the fully engaged position, the elements are arrayed in a generally X-shaped configuration with the elements generally oppositely disposed to one another along respective first and second legs of the X-shape. Preferably, at least one of the elements includes a member that projects generally normal to the plane of the X-shaped configuration, and is positioned to engage the surface of the load to which the lift coupling is engaged. This laterally extending member or boss serves to resist loads that are applied in a direction approximately normal to the plane of the X-shaped configuration to protect the lift coupling and dovetail socket from damage.

At least one of the dovetail socket engaging elements includes a lifting eye. The application of lifting force to the lifting eye causes the socket engaging elements to wedgedly lock with the dovetail socket. In a preferred embodiment, where a lifting eye is provided in both elements, the respective lifting eyes are brought into registry with one another when the elements are in the fully engaged configuration so that a lifting member will pass through both of them. The presence of a lifting member in the combined lifting eyes serves to hold the elements in the configuration where they are fully engaged with the dovetail socket.

The two elements of the coupling are preferably retained in the assembled configuration so that the axial movement of the second element is confined to movement between the engaged and disengaged configurations, and sliding the second element to the fully disengaged configuration does not result in the separation of the two elements. Preferably, the elements are substantially permanently assembled so that the second element can not be released from engagement with the first element under normal circumstances.

The present invention provides a rugged, yet simple lift coupling which can be reliably and repeatedly engaged and disengaged from a dovetail socket without the use of tools, or at most, with the use of nothing more than a hammer to lightly tap the elements. The use of a single assembly that is robustly and reliably secured together, and with only one moving part, provides significant improvements in safety, and savings in manufacturing, transporting, handling, storage, and operating costs. The lift coupling can be used as cast or forged with only one machining operation on each of the two elements, and that to provide the retainer assembly to secure the elements together in slidable relationship. The relative movement between the two parts is linear, so no complicated pivoting or other motion is required, and the machining or other formative operations to provide such pivotal or rotational motion are not needed. The potential for damaged or jammed rotational or pivotal parts is thus eliminated.

Other objects, advantages, and novel features of the present invention will become apparent from the following detailed description of the invention when considered in conjunction with the accompanying drawings.

BRIEF DESCRIPTION OF THE DRAWINGS

The present invention provides its benefits across a broad spectrum of lift couplings. While the description which follows hereinafter is meant to be representative of a number of such applications, it is not exhaustive. As those skilled in the art will recognize, the basic methods and apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

Referring particularly to the drawings for the purposes of illustration only and not limitation:

FIG. 1 is an oblique view of a preferred embodiment of the lift coupling invention depicting a lock block with a key member slidably inserted through a keyway in the lock block to form a generally X-shaped dovetail socket engaging configuration.

FIG. 2 is a side view of the embodiment of FIG. 1.

FIG. 3 is an oblique view of the key member illustrated in the embodiment of FIG. 1.

FIG. 4 is a side view of the key member illustrated in FIG. 3.

FIG. 5 is a rear view of the key member illustrated in FIG. 3.

FIG. 6 is a front view of the key member illustrated in FIG. 3.

FIG. 7 is an oblique view of the lock block depicted in the embodiment of FIG. 1.

FIG. 8 is a top view of the lock block depicted in FIG. 7.

FIG. 9 is a cross-sectional view of the lock block illustrated in FIG. 7 taken along line 9-9 in FIG. 10.

FIG. 10 is a front view of the lock block depicted in FIG. 7.

FIG. 11 is a cross-sectional view of a further embodiment of a lift coupling of the present invention installed in a dovetail socket, wherein the lift hook receiving port is entirely within the lock block so that the presence of a lifting member in the lifting eye does not positively lock the lift coupling in a fully engaged configuration.

FIG. 12 is a cross-sectional view similar to FIG. 9 illustrating a preferred embodiment wherein a pin and slot retainer system is arrayed along different faces of the cooperating latching members.

FIG. 13 is a cross-sectional view similar to FIG. 12 wherein the locations of the pin and slot are reversed.

FIG. 14 is a view similar to FIG. 8 of the embodiment shown in FIG. 13.

FIG. 15 is a view similar to FIG. 4 of the embodiment of FIG. 13.

FIG. 16 is a view similar to FIG. 16 is a view similar to FIG. 3 of the embodiment of FIG. 12.

DETAILED DESCRIPTION OF THE PREFERRED EMBODIMENTS

Referring now to the drawings wherein like reference numerals designate identical or corresponding parts throughout the several views, there is illustrated generally at 10 a lift coupling comprised of coupling latching members including a lock block 14 and a slidably moveable key member 16. Keyway 20 extends angularly through lock block 14. Key member 16 is slidably received in keyway 20 for axial movement as indicated at 18 between a position where it is fully engaged with a dovetail socket, and a position where it is fully disengaged from a dovetail socket.

A typical dovetail socket of conventional design is shown in the embodiment indicated generally at 12 (FIG. 11). One lift engaging wall of the dovetail socket is shown, for example, at 27. The dovetail socket is provided, for example, in dovetail plate 24. Dovetail plate 24 is affixed, either permanently or removably, to the surface of a load 26. As is conventional, the dovetail socket may be formed in a dovetail plate, as shown, or in the load itself, and may or may not extend entirely through the load, as desired. Where the dovetail socket does not extend entirely through the load, it is generally preferred that the lift coupling not bear firmly against the bottom of the socket when fully engaged. This provides enough play in the engagement between the socket and the lift coupling that they can be disengaged by hand when there is no lifting force applied to the coupling.

Lock block 14 includes a boss having a surface 22. Surface 22 is adapted to bear against the surface of a load or dovetail plate adjacent to the dovetail socket. This prevents the application of a load in a direction approximately normal to the plane of the X-configuration from twisting the lift coupling 10 out of the dovetail socket in which it is mounted, or damaging the lift coupling and/or the dovetail socket.

As illustrated particularly in FIGS. 2 and 11, the embodiments chosen for illustration, the lock block and key member comprise fixed and moveable legs, respectively, that are arranged in generally an X-shaped configuration. The key member 16 (FIG. 1), or 64 (FIG. 11), forms a moveable second leg of the X form. The lock block 14 (FIG. 1), or 62 (FIG. 11), forms a fixed first leg of the X form. The moveable leg is slidably mounted to the fixed leg so that the socket engaging portion of the moveable leg slides through the fixed leg along an axis parallel to its own axis. Particularly in those embodiments wherein the passage or keyway within which the moveable leg is mounted is fully enclosed by and extends entirely through the fixed leg, the very simple structure is extremely strong and rigid. The respective legs lever against one another under the application of a lifting load as each leg attempts to rotate to a position where it would extend parallel to the other. In, for example, the embodiment of FIG. 1, the application of a lifting load to lifting eyes 36 and 58 causes lifting toe 32 on the moveable leg to attempt to rotate down towards first heel 34, and causes first face 42 to bear strongly against the mating surface of the fixed leg. In the embodiment of FIG. 11, the resistance to this relative rotation of the respective legs is offered by the engagement of key member 64 with a mating passageway in the fixed leg. There is no rotational resistant facial engagement between the respective legs corresponding to that between face 42 and the mating surface of the fixed leg in the embodiment of FIG. 1. Likewise, the application of a lifting load to toe element 28 causes the fixed leg to attempt to rotate towards heel element 30, and it is similarly resisted.

In the embodiment chosen for illustration, the axially moveable and fixed legs are releasably assembled together. A retainer assembly is provided for this purpose. The illustrated retainer assembly comprises a threaded pin 56 (FIG. 9) or 68 (FIG. 11). The threaded pin is adapted to being guidably received within a slot 40 (FIG. 6), or 66 (FIG. 11). The threaded pin loosely engages the slot so that the moveable leg is free to move back and forth along its own longitudinal axis, as indicated at 18 (FIGS. 1-2) and 70 (FIG. 11). As will be understood by those skilled in the art other retainer assemblies can be used. For example, a dowel pin could be used instead of a threaded pin. This would provide a substantially permanent assembly, because the pin could not be easily withdrawn. This would also eliminate the requirement for a machining operation to thread the hole. It would tend to improve safety in that if one element of the assembly were visibly damaged, the whole assembly would be discarded on the assumption that the other element might have hidden damage. The engagement of the pins with the respective ends of the slots prevents the moveable leg from being separated from the fixed leg, even at the fully engaged or disengaged positions.

The keyway 20, in the embodiment of FIG. 1, is bounded by walls 50, 52, 53, and 54. When key member 16 is slidably received in Keyway 20, face 48 is mated with wall 52, face 38 is mated with wall 50, face 46 is mated with wall 53, and toe element 32 is mated with wall 54. The faces of key member 16 are thus fully enclosed by the walls in the passageway through the fixed leg. The walls of the fixed leg are of sufficient thickness to resist the application of a lifting load from any direction.

When a lifting member, not illustrated, is inserted from, for example, face 44 of the moveable leg completely through lifting eyes or ports 36 and 58, the presence of the lifting member not only tends to hold the fixed and moveable legs in a fully engaged configuration with the dovetail socket, but also tends to distribute the load between the two legs. In the embodiment of FIG. 11, for example, the lifting eye or port 60 is only in the fixed leg and its axis extends normal to the plane of the X-form. The lift coupling chosen for illustration in FIG. 11 is of sufficient mass to support the designed loads without providing a lifting eye in each leg.

In a preferred embodiment, alternative versions of which are illustrated, for example, in FIGS. 12 and 16, and FIGS. 13, 14 and 15, respectively, a retainer pin and mating slot arrangement are disposed between a side face of key member 16 and a matching wall of the lock block 14 in keyway 20. Referring particularly to FIGS. 12 and 16, a pin retaining slot 78 is located in wall 52 of a coupling member. A retainer pin 82 (FIG. 16) on the opposing face 46 of the mating latching member slidably engages slot 78. FIGS. 13, 14, and 15 illustrate a configuration in which the retainer pin and matching slot are positioned on the opposite members of the coupling, as compared to the embodiment of FIG. 12. Retainer pin 76 projects into keyway 20 through wall 52. Slot 84 is formed in key member 16. When assembled together pin 76 is slidably received in slot 84. Key member 16 is preferably provided with a shoulder 80, which engages toe element 28 adjacent the keyway to strengthen the assembly, and positively prevent the key member 16 from rotating slightly and sliding partially through keyway 20 under a misapplied load or during unloaded handling. With the pin-slot configuration of FIGS. 12-16, the elements of the coupling are securely bound together. Pin-slot retainer systems, or the like, can be provided on one, two, or three sides of keyway 20 as may be desired. Positioning pin-slot retainer systems on opposed sides of keyway 20 provides a particularly secure arrangement. Additional security is provided by providing key member 16 with shoulders, a typical one of which is shown at 80. If desired, similar shoulders, not shown, can be provided on the slidable member of the embodiment of the coupling illustrated, for example, in FIG. 11. When pins are pressed into the receiving structure after the members are assembled together, the assembly is substantially permanent. The assembled members are not at risk of being separated in storage or transportation, yet they can be quickly assembled by hand to a matching dovetail socket.

What have been described are preferred embodiments in which modifications and changes may be made without departing from the spirit and scope of the accompanying claims. Clearly, many modifications and variations of the present invention are possible in light of the above teachings. It is therefore to be understood that, within the scope of the appended claims, the invention may be practiced otherwise than as specifically described.

What is claimed is:

1. A lift coupling for quick releasable engagement with juxtaposed first and second angularly extending walls of a dovetail socket comprising:

a lock block having a first toe element adapted to wedgingly engage said first angularly extending wall of said dovetail socket, a lifting member receiving port, and a keyway passing angularly through said lock block;

an axis extending through said lock block generally parallel to said keyway;

a key member slidably received in said keyway, said key member having a second toe element adapted to wedgingly engage said second angularly extending wall, said key member being slidably received in said keyway, said key member being generally confined by said keyway to generally linear movement along said axis between full said wedging engagement and full disengagement configurations with said second angularly extending wall, said axis being adapted to extend generally parallel to said second angularly extending wall during said generally linear movement, said second toe element being generally opposedly disposed from said first toe element when engaged with said dovetail socket; and a retainer assembly adapted to slidably retain said key member in said keyway for said generally linear movement between said full engagement and disengagement.

2. A lift coupling for quick releasable engagement with a conventional dovetail socket, said conventional dovetail socket including first and second lift engaging walls projecting angularly with respect to one another, said lift coupling comprising:

a lock block having a first toe element including opposed first and second sides, said first side being adapted to engage said first lift engaging wall, a lifting member receiving port, and a keyway passing angularly with respect to said first and second sides entirely through said first toe element from said first side to said second side;

an axis extending through said lock block generally parallel to said keyway;

a key member received in said keyway, said key member having a second toe element adapted to engage said second lift engaging wall, said key member adapted for generally slidable axial movement generally parallel to said axis between full engagement and full disengagement with said second lift engaging wall, said second toe element being generally opposedly disposed from said first toe element when engaged with said second lift engaging wall, whereby the application of a lifting force to said lift coupling locks said first and second toe elements in said dovetail socket, and removing said load releases said first and second toe elements, said lock block including a boss having a face, said face being adapted to engaging a surface of a load adjacent to said dovetail socket, said face being generally spaced from said first toe element; and a retainer assembly adapted to slidably retain said key member in said keyway for movement between said full engagement and disengagement.

3. A lift coupling for quick releasable engagement with a conventional dovetail socket, said conventional dovetail socket including first and second angularly projecting walls, said lift coupling comprising:

a first dovetail socket engaging element, a socket engaging portion of a first toe element of said first dovetail socket engaging element being adapted to engage said first angularly projecting wall, said first toe element including a passage extending therethrough from a side of said toe element where said socket engaging portion is located to a side of said first dovetail socket engaging element opposed to said socket engaging portion:

an axis through said first toe element, said axis extending generally parallel to said passage:

a second dovetail socket engaging element, said second dovetail socket engaging element including a second toe element received in said passage and adapted for substantially linear sliding movement through said passage along said axis between full engagement and full disengagement with said second angularly projecting wall, said first and second toe elements adapted to projecting generally angularly away from one another in a generally X-shaped configuration when so engaged, at least one of said first and second dovetail socket engaging elements including a lifting eye, said lifting eye being adapted to being engaged by a lifting member, said first and second toe elements being adapted to being wedgedly locked in said dovetail socket by the application of a lifting force to said lifting eye.

4. A lift coupling for quick releasable engagement with a dovetail socket, said lift coupling having a generally X-shaped configuration, said lift coupling comprising:

a first dovetail socket engaging element generally defining a first leg of said generally X-shaped configuration and including a side having a socket engaging portion and a side opposed to said side having a socket engaging portion; and a second dovetail socket engaging element, said second dovetail socket engaging element defining a second leg of said generally X-shaped configuration, said first and second dovetail socket engaging elements slidably interengaged, at least one of said first and second dovetail socket engaging elements including a lifting eye, said lifting eye being adapted to being engaged by a lifting member, said first and second dovetail engaging elements being adapted to being wedgedly locked in said dovetail socket by the application of a lifting force to said lifting eye, said second dovetail socket engaging element extending through a passage in said first dovetail socket engaging element and projecting from both said side having a socket engaging portion and said side opposed to said side having a socket engaging portion, and adapted for generally slidable axial movement along an axis of said second leg between positions of full engagement and full disengagement with said dovetail socket, said second dovetail socket engaging element being confined to substantially linear movement during said generally slidable axial movement within said passage between said full engagement and said full disengagement.

5. A lift coupling for quick releasable engagement with a conventional dovetail socket, said conventional dovetail socket including first and second lift engaging walls projecting angularly with respect to one another, said lift coupling comprising:

a lock block having a first toe element including opposed first and second sides, said first side being adapted to engage said first lift engaging wall a lifting member receiving port, and a keyway passing angularly with respect to said first and second sides entirely through said first toe element from said first side to said second side;

an axis extending through said lock block generally parallel with said keyway;

a key member axially slidably received in said keyway, said key member having a second toe element adapted to engage said second lift engaging wall, and a second lifting member receiving port, said key member adapted to being axially slideable generally parallel to said axis between full engagement and full disengagement with said second lift engaging wall, said second toe element being generally opposedly disposed from said first toe element when engaged with said second lift engaging wall, said first and second lifting member receiving ports being generally in registry with one another and adapted to receive a lifting member therethrough when said key member is in full engagement with said second lift engaging wall; and a retainer assembly adapted to slidably retain said key member in said keyway during axially slidable movement between said full engagement and said full disengagement.

6. A lift coupling of claim 5 wherein said retainer assembly is releasable.

7. A lift coupling for quick releasable engagement with a dovetail socket according to claim 5 including:

said retainer assembly including at least one pin in one of said key member and said lock block, and at least one slot in the other of said key member and said lock block, said pin and slot being retainingly and slidably associated with one another.

8. A lift coupling for quick releasable engagement with a dovetail socket according to claim 5 including:

said retainer assembly including a shoulder element on said key member adapted to engage said lock block on said side having a socket engaging portion adjacent to said keyway when in a fully assembled configuration.

9. A coupling of claim 2 wherein said retainer assembly is releasable.

10. A lift coupling for quick releasable engagement with a conventional dovetail socket, said conventional dovetail socket including first and second lift engaging walls projecting angularly with respect to one another, said lift coupling comprising:

a lock block having a first toe element including opposed first and second sides, said first side being adapted to engage said first lift engaging wall, a first lifting member receiving port, and a keyway passing angularly with respect to said first and second sides entirely through said first toe element from said first side to said second side;

an axis extending through said lock block generally parallel to said keyway;

a key member received in said keyway, said key member having a second toe element adapted to engage said second lift engaging wall, said key member adapted for generally slidable axial movement generally parallel to said axis between full engagement and full disengagement with said second lift engaging wall, said second toe element being generally opposedly disposed from said first toe element when engaged with said second lift engaging wall, said key member including a second lifting member receiving port, said second lifting member receiving port being adapted to being axially aligned with said first lifting member receiving port forming substantially a single port when said key member is fully engaged with said second lift engaging wall, whereby the application of a lifting force to said lift coupling locks said first and second toe elements in said dovetail socket, and removing said load releases said first and second toe elements; and a retainer assembly adapted to slidably retain said key member in said keyway for movement between said full engagement and disengagement.

* * * * *